US010807819B2

(12) United States Patent
Jackson et al.

(10) Patent No.: US 10,807,819 B2
(45) Date of Patent: Oct. 20, 2020

(54) LANDING PAD FOR CUT MEDIA

(71) Applicant: ZEBRA TECHNOLOGIES CORPORATION, Lincolnshire, IL (US)

(72) Inventors: Ronald D. Jackson, Woodstock, IL (US); Blake Nemura, Saint Charles, IL (US); Daniel Lanigan, Elgin, IL (US); Robert Grom, Hawthorn Woods, IL (US); David Jarovsky, Lake in the Hills, IL (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 16/356,911

(22) Filed: Mar. 18, 2019

(65) Prior Publication Data

US 2019/0210824 A1 Jul. 11, 2019

Related U.S. Application Data

(63) Continuation of application No. 13/308,259, filed on Nov. 30, 2011, now abandoned.

(51) Int. Cl.
*B65H 7/00* (2006.01)
*B41J 3/407* (2006.01)

(52) U.S. Cl.
CPC ..... *B65H 7/00* (2013.01); *B41J 3/4075* (2013.01); *B65H 2511/528* (2013.01); *B65H 2513/511* (2013.01); *B65H 2513/512* (2013.01); *B65H 2801/06* (2013.01)

(58) Field of Classification Search
CPC .. B65H 35/0006; B65H 35/04; B65H 35/006; B65H 35/0066; B65H 35/06; B65H 35/08; B65H 7/00
USPC ..... 270/52.09
See application file for complete search history.

(56) References Cited

U.S. PATENT DOCUMENTS 2,382,998 A * 8/1945 Kleinschmidt ..... B65H 33/04 270/58.31
3,070,365 A * 12/1962 Lohrmann ..... B65H 26/02 270/52.09
4,502,676 A * 3/1985 Stocker ..... B65H 31/24 209/564
4,866,472 A * 9/1989 Yamakoshi ..... G03D 13/003 355/27
4,944,503 A * 7/1990 Arima ..... B26D 7/32 270/52.09
5,215,393 A 6/1993 Wincent
5,560,293 A 10/1996 Boreali et al.
5,751,330 A 5/1998 Austin et al.
(Continued)

FOREIGN PATENT DOCUMENTS

EP 1577860 A2 9/2005
EP 1870363 A1 12/2007
(Continued)

*Primary Examiner* — Patrick H Mackey

(57) ABSTRACT

An embodiment of an assembly has a landing pad configured to receive media after the media is cut. The landing pad defines a first end adjacent a cutter, a second end opposite the first end, and a gap positioned between the first end and the second end. The assembly has an emitter, wherein the gap is configured to allow light from the emitter to pass through the gap when the media is not located on the landing pad.

18 Claims, 8 Drawing Sheets

(56) References Cited

U.S. PATENT DOCUMENTS

| | | | | |
|---|---|---|---|---|
| 5,806,993 | A | 9/1998 | Petterutti et al. | |
| 5,993,093 | A | 11/1999 | Schoennauer et al. | |
| 5,997,193 | A | 12/1999 | Petterutti et al. | |
| 6,010,257 | A | 1/2000 | Petteruti et al. | |
| 6,206,071 | B1 | 3/2001 | Majkrzak et al. | |
| 6,261,009 | B1 | 7/2001 | Petteruti et al. | |
| 6,428,227 | B2 | 8/2002 | Petteruti et al. | |
| 6,585,437 | B1 | 7/2003 | Wiklof et al. | |
| 6,884,312 | B2 | 4/2005 | Mitchell et al. | |
| 7,101,100 | B2 | 9/2006 | Hoshino et al. | |
| 7,329,449 | B2 | 2/2008 | Wiklof et al. | |
| 7,363,179 | B1 | 4/2008 | Missell et al. | |
| 7,401,779 | B2 * | 7/2008 | Sekiya ..... | G01N 21/8901 271/265.01 |
| 7,588,811 | B2 | 9/2009 | Blank et al. | |
| 7,808,517 | B2 | 10/2010 | Sambongi et al. | |
| 7,820,264 | B2 | 10/2010 | Blank et al. | |
| 7,891,647 | B2 * | 2/2011 | Nakane ..... | B42C 1/12 270/10 |
| 7,896,564 | B2 | 3/2011 | Heaton et al. | |
| 8,013,272 | B2 * | 9/2011 | Hayashi ..... | G03G 15/6582 219/121.67 |
| 2001/0026725 | A1 | 10/2001 | Petteruti et al. | |
| 2002/0057300 | A1 | 5/2002 | Baker et al. | |
| 2003/0089452 | A1 | 5/2003 | Hansen et al. | |
| 2003/0192639 | A1 | 10/2003 | Mitchell et al. | |
| 2003/0223800 | A1 | 12/2003 | Wiklof et al. | |
| 2004/0004656 | A1 | 1/2004 | Sambongi et al. | |
| 2004/0112520 | A1 | 1/2004 | Hanschen et al. | |
| 2005/0186009 | A1 | 8/2005 | Baker et al. | |
| 2005/0190368 | A1 | 9/2005 | Ehrhardt et al. | |
| 2005/0208250 | A1 | 9/2005 | Blank et al. | |
| 2006/0083570 | A1 | 4/2006 | Hoshino et al. | |
| 2006/0280541 | A1 | 12/2006 | Lass | |
| 2007/0074809 | A1 | 4/2007 | Phillips | |
| 2007/0252886 | A1 | 11/2007 | Sambongi et al. | |
| 2007/0268355 | A1 | 11/2007 | Sato | |
| 2008/0095565 | A1 | 4/2008 | Ray | |
| 2008/0152417 | A1 | 6/2008 | Heaton et al. | |
| 2010/0135680 | A1 | 6/2010 | Adachi et al. | |
| 2010/0278578 | A1 | 11/2010 | Yamada | |
| 2011/0033698 | A1 | 2/2011 | Woods et al. | |
| 2011/0205326 | A1 | 8/2011 | Roth et al. | |
| 2011/0273504 | A1 | 11/2011 | Boesten et al. | |

FOREIGN PATENT DOCUMENTS

| | | | |
|---|---|---|---|
| EP | 1440888 | B1 | 12/2009 |
| EP | 1577860 | B1 | 9/2010 |
| EP | 1354718 | B1 | 2/2012 |
| WO | 01096184 | A1 | 12/2001 |
| WO | 03086761 | A2 | 10/2003 |
| WO | 05075330 | A2 | 8/2005 |
| WO | 08051645 | A1 | 5/2008 |

* cited by examiner

LANDING PAD FOR CUT MEDIA

RELATED APPLICATION

This patent arises from a continuation of U.S. patent application Ser. No. 13/308,259, filed on Nov. 30, 2011, which is hereby incorporated herein by reference.

FIELD

Embodiments of the present invention relate generally to printer systems and, more particularly, relate to methods, apparatuses, computer readable media, systems and other means for printing on linerless media.

BACKGROUND

Embodiments of the present invention are directed to printers and other systems for processing media including adhesive labels, retail receipts, building access card keys, and parking deck tickets, among other things. A number of deficiencies and problems associated with the manufacture, use, and maintenance of conventional printers have been identified. Through applied effort, ingenuity and innovation, solutions to many of these identified problems have been solved by developing solutions that are included in the various embodiments of the present invention, some examples of which are detailed below.

BRIEF DESCRIPTION OF THE SEVERAL VIEWS OF THE DRAWINGS

Reference will now be made to the accompanying drawings, which are not necessarily drawn to scale, and wherein.

SUMMARY

Figure 1A:
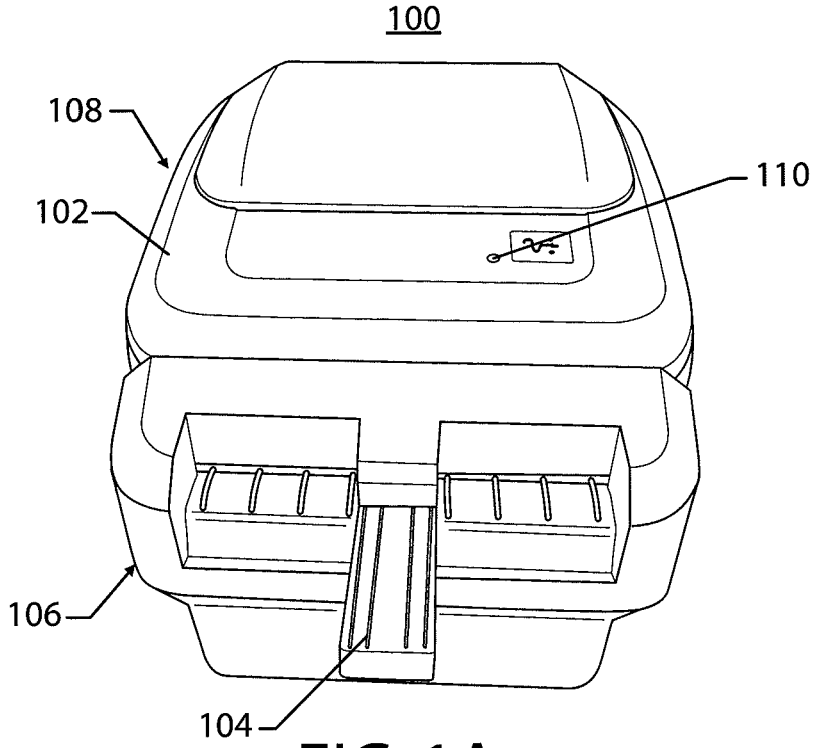
FIGS. 1A-1C show various views of a printer in accordance with some embodiments discussed herein.

Embodiments include systems, apparatuses, methods computer readable media and other means for providing a printer comprising, among other things, a processor, a first sensor and a second sensor. The first sensor positioned along a media feed path upstream from a printing component. The first sensor configured to detect media movement and generate observation data associated with the movement of the media. The second sensor positioned along the media feed path downstream from the printing component. The second sensor configured to detect the media and, in response, generate media present data. The processor configured to, among other things, receive an observation signal associated with the observation data; determine when the second sensor is expected to detect the media based on the observation signal; receive a media present signal associated with the media present data; and stop printing in response to failing to receive the media present signal when expected as determined based on the observation signal.

The processor can also be configured to generate an alert indicative of a platen wrap condition in response to failing to receive the media present signal when expected as determined based on the observation signal. While the processor can be configured to stop printing and generate an alert in some instances when the media present signal is not received as expected, the processor can also be configured to stop printing without generating an alert in response to receiving the media present signal when expected as determined based on the observation signal.

In some embodiments, a preconfigured margin of error can be incorporated into determining when the second sensor is expected to detect the media. The margin of error is configurable in response to receiving a user input. The margin of error can also be configured to allow less than an entire media unit to wrap around the platen.

The configuration data can be used to determine when the second sensor is expected to detect the media. The configuration data can be determined empirically by the printer. The configuration data could also or instead be downloaded by the printer from a remote source. The configuration data is specific to the media being printed.

In some embodiments, when the second sensor is expected to detect the media, can be expressed in terms of reference units. The reference units may be associated with motor steps used to move the media through the printer and/or the reference units may be associated with rotational movement of a component within the printer, such as a media roll.

Some embodiments may also include a printer configured to conduct an empirical calibration process. In such embodiments, the printer can comprise, for example, a reference unit generator that generates reference units associated with movement of media; a first sensor positioned along a media feed path upstream from a printing component, the first sensor configured to detect the movement of the media; a second sensor positioned along the media feed path downstream from the printing component, the second sensor configured to detect the media; and a processor configured to count the reference units required to move the media from the first sensor to the second sensor. The processor can be further configured to generate calibration data based on how many reference units are required to move the media from the first sensor to the second sensor.

A maximum number of reference units can be determined, wherein the maximum number of reference units are associated with the movement of the media from the first sensor to the second sensor. The calibration process can be determined to have failed in response to determining the media will require more than the maximum number of reference units to move the media from the first sensor to the second sensor. In response to determining the calibration process has failed, retrieve previously stored calibration data.

The processor can be further configured to count the reference units required to move the media to the first sensor from a media source, such as a roll of media, stack of media (e.g., cards), fan-folded media, and/or any other suitable source of media. The processor can be further configured to generate calibration data based on how many reference units are required to move the media to the first sensor from the media source. The printer can also be configured to determine maximum number of reference units associated with the movement of the media to the first sensor from the media source, which may be the same as or different than the maximum number of reference units associated with moving the media between the first sensor and the second sensor. The calibration process can be determined to have failed in response to determining the media will require more than the maximum number of reference units to move the media to the first sensor from the media source.

The printer and/or its processor can be additionally or instead configured to count the reference units required to move the media to the second sensor from a media source. In such embodiments, the processor can be further configured to generate calibration data based on how many reference units are required to move the media to the second sensor from the media source. The processor can be configured to determine a maximum number of reference units associated with the movement of the media to the second sensor from the media source; and determine a calibration process has failed, in response to determining the media will require more than the maximum number of reference units to move the media to the second sensor from the media source.

The printer can also, in some embodiments, be configured to begin to count the reference units in response to detecting new media is installed in the printer. Additionally or alternatively, the printer can be configured to begin to count the reference units in response to detecting a new type of media is installed in the printer as compared to old media used previously to conduct a calibration process.

Some embodiments of the printer may also include a component having a cutter, the media taken sensor, and/or a landing pad onto which the printed media is outputted. The landing pad may be relatively narrow and long.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1B:
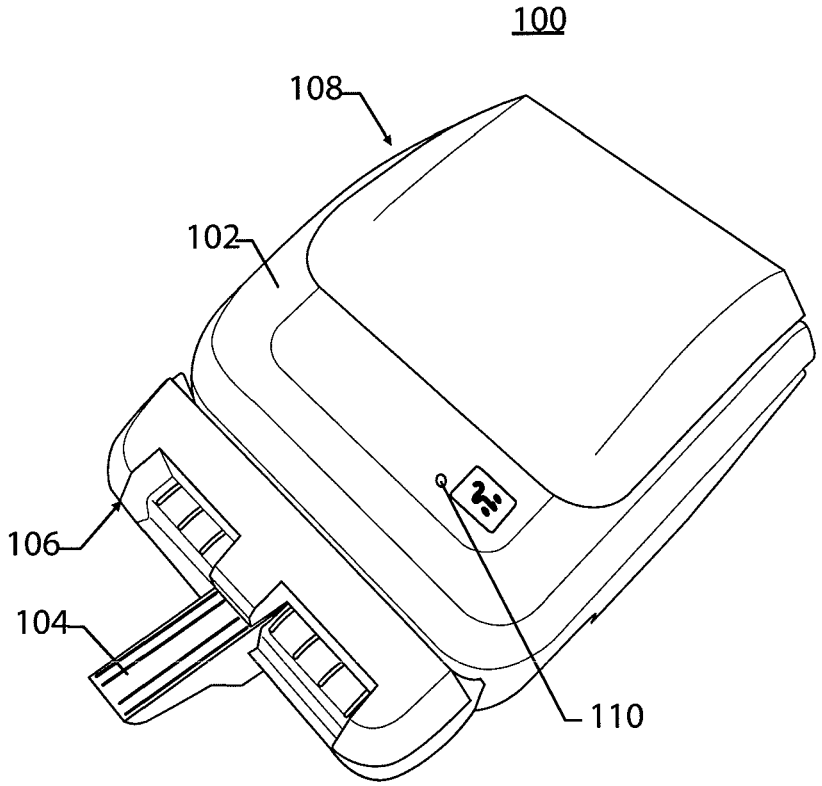
Figure 1C:
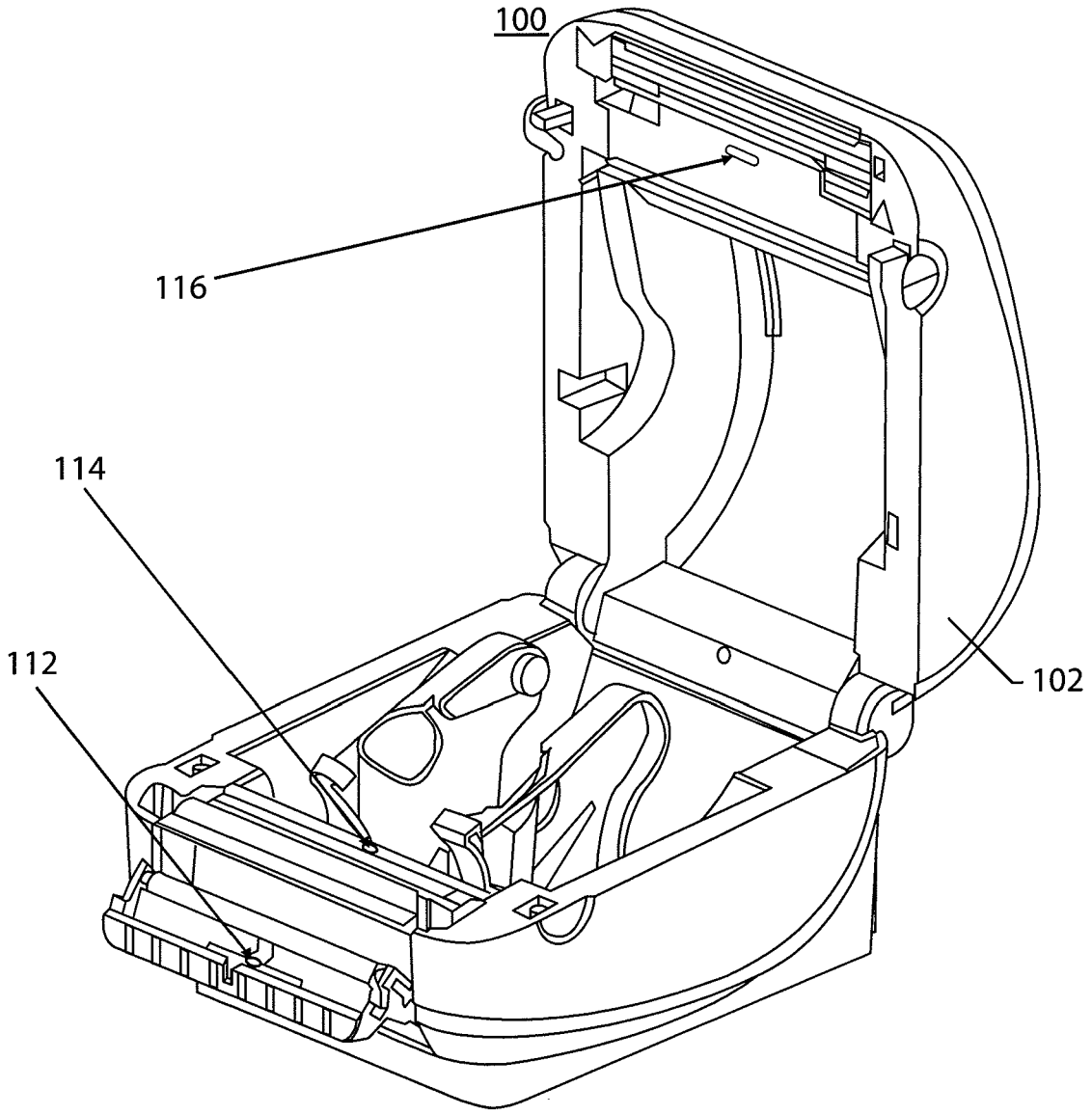

FIGS. 1A-1C show various views of printer 100. For example, FIG. 1A shows a front perspective view of printer 100, FIG. 1B shows a top perspective view of printer 100, and FIG. 1C shows a view of printer 100 with its lid 102 in the open position (as opposed to in the closed position as shown in FIGS. 1A and 1B). Also shown in FIGS. 1A and 1B is landing pad 104, which may be included in component 106. In some embodiments, component 106 may be detachable and/or otherwise removably coupled to main body 108 of printer 100 and removed as shown in FIG. 1C. Examples of landing pad 104 and other features of component 106 are discussed further in connection with FIGS. 5A-5E.

In addition to lid 102, main body 108 may include one or more user interface components, such as light emitting device 110. While light emitting device 110 is shown in FIGS. 1A and 1B as a multi-color light emitting device, one or more additional user interfaces may also be included in printer 100. For example, one or more graphical user interfaces, audio speakers, haptic feedback components (e.g., vibrating components), and/or any other interface component(s) configured to convey information, such as the status of printer 100, may be included in main body 108 and/or any other component of printer 100.

Printer 100 can be configured to print on linerless media and reduce problems associated with previously known linerless printers. Among other things, in embodiments of printer 100 that includes a platen roller, printer 100 can be configured to reduce the impact of media wrapping around the platen roller (sometimes referred to herein as "platen wrap"). Platen wrap can cause the printer to jam and, the farther the media is fed into the platen after the wrap begins, the more difficult and frustrating it can be for the user to remedy. In this regard, some embodiments can be configured to provide for early detection of existing platen wrap conditions and/or conditions internal to the printer that are indicative and/or conducive to platen wrap occurring or about to occur. Such conditions are sometimes referred to herein as "platen wrap conditions". In response to detecting one or more platen wrap conditions (e.g., using the systems, components, computer readable media and/or methods described herein), printer 100 may be configured to minimize the jam by, for example, stop printing, notifying the user of an error condition requiring user intervention, and/or by any other suitable means.

For example, a platen wrap condition can be detected by interpreting the outputs of two or more sensors and/or other components included in printer 100. As shown in FIG. 1C, printer 100 may include media taken sensor 112, black mark sensor 114 and/or gap sensor 116. While some embodiments may include all three sensors (and/or any other type of sensor), black mark sensor 114 and gap sensor 116 can be used nearly interchangeably to provide some functionality of some embodiments. In such embodiments, for example, printer 100 may consist of media taken sensor 112 and black mark sensor 114, or printer 100 may consist of media taken sensor 112 and gap sensor 116. Because black mark sensor 114 and gap sensor 116 can be used nearly interchangeably to provide some functionality discussed herein, black mark sensor 114 and gap sensor 116 are sometimes referred to herein as "internal sensor 114/116". Internal sensor 114/116 refers to black mark sensor 114, gap sensor 116, the combination of black mark sensor 114 and gap sensor 116, or the combination of either or both of black mark sensor 114 and gap sensor 116 and any internal sensor other than media taken sensor 112.

Media taken sensor 112 and internal sensor 114/116 can include any suitable type(s) of sensor(s). For example, one or more of media taken sensor 112 and internal sensor 114/116 can include one or more proximity sensors (configured to detect an object in close proximity), ambient light sensors (configured to detect ambient light), reflective sensors (configured to emit light and detect the amount of the light reflected back), transmissive sensors (configured emit light and detect light by a receiver 222 placed opposite the emitter), and/or any other sensor. For example, black mark sensor 114 may be a reflective sensor configured to determine, e.g., the presence of black marks on a white background and/or gap sensor 116 may be a transmissive sensor configured to determine whether there is an object is obstructing the line of sight between the sensor's emitter and receiver 222.

The sensors in printer 100 can be configured to use (e.g., emit and/or detect) one or more specific wavelengths of light. For example, all the sensors included in printer 100 may be infrared sensors. As another example, media taken sensor 112 may be an ambient light sensor configured to detect light having a wavelength in the visual spectrum, while black mark sensor 114 and/or gap sensor 116 are configured to detect the presence, absence and/or intensity of infrared light. Additionally or alternatively, the sensors of printer 100 may be configured to use ultraviolet light, sound waves, and/or any other suitable means for detecting the presence of an object and/or characteristic thereof.

Figure 2A:
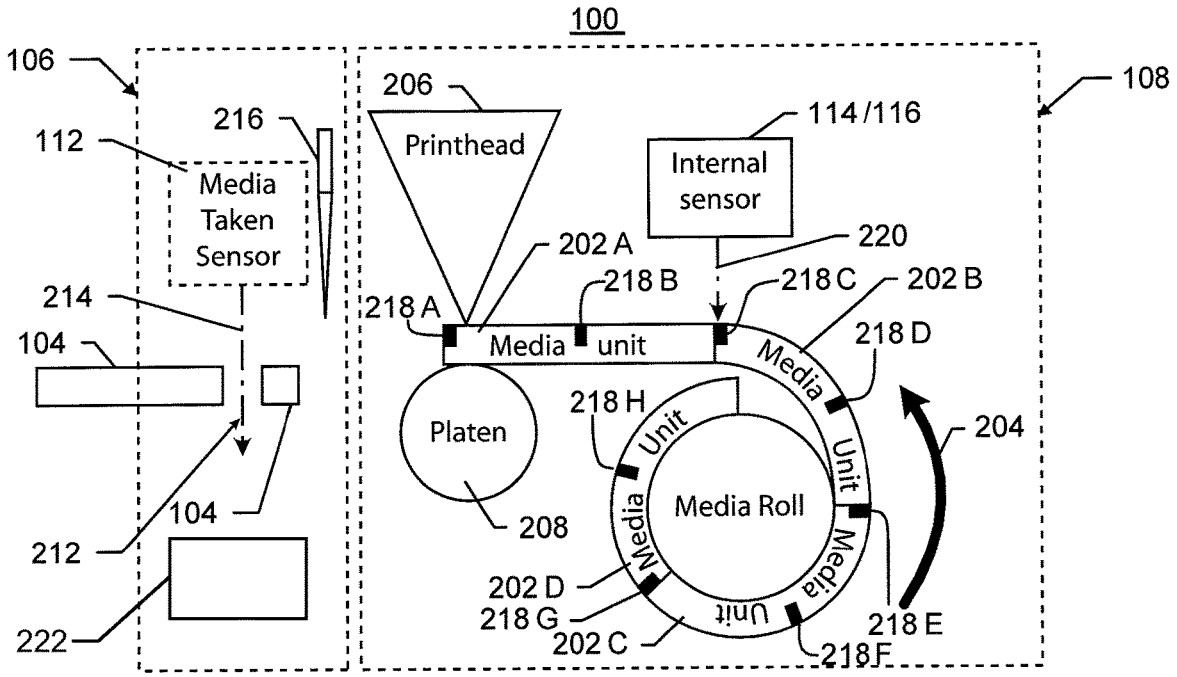
FIGS. 2A-2C show a series of block diagrams illustrating an example of how media units may move through a printer in accordance with some embodiments discussed herein.
Figure 2B:
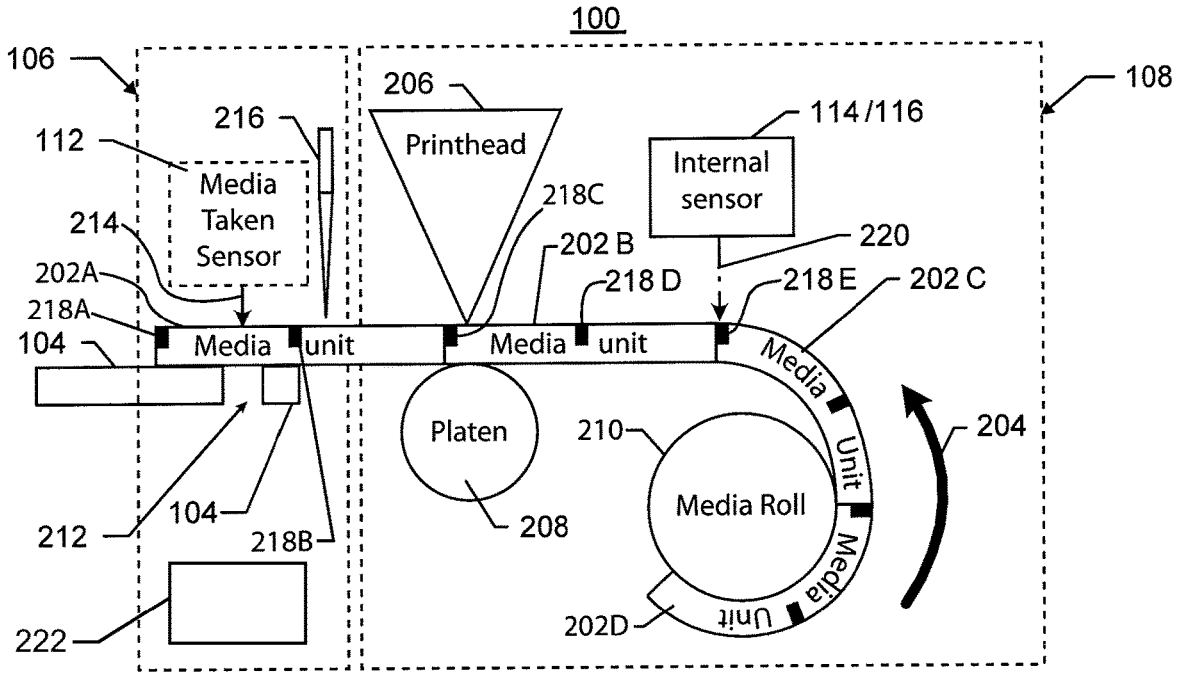
Figure 2C:
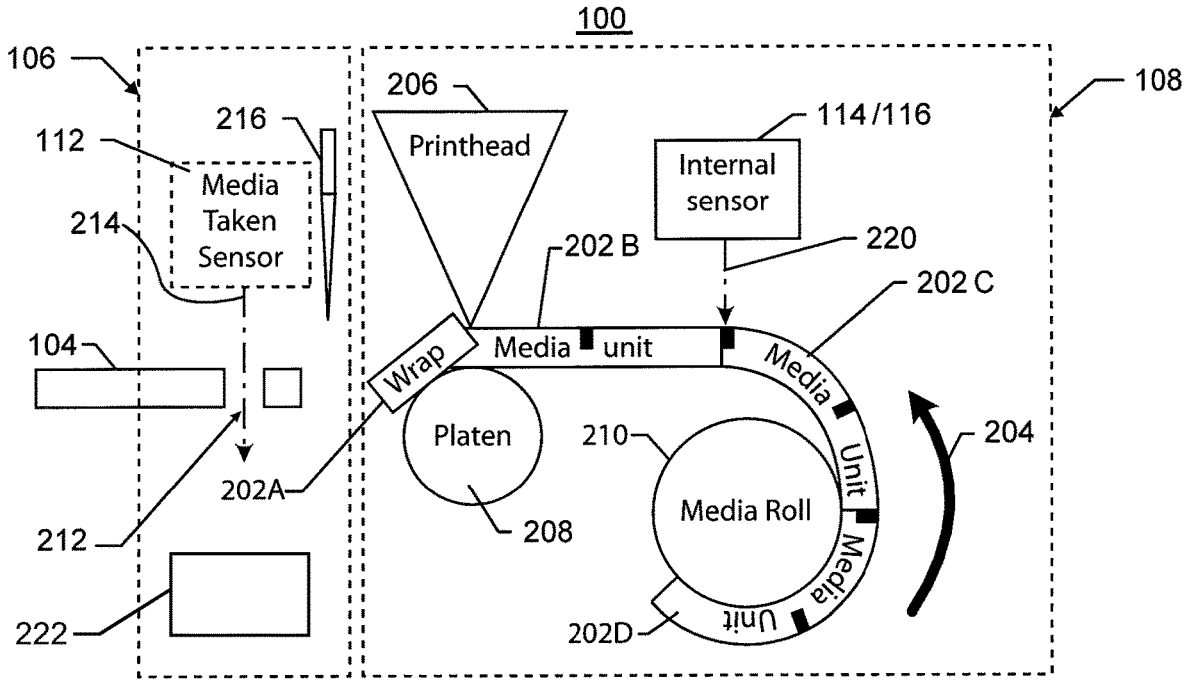

FIGS. 2A-2C show a series of block diagrams illustrating an example of how media units 202A, 202B, 202C and 202D may move in the direction of motion arrow 204 through a printer, such as printer 100, relative to an example placement of media taken sensor 112 and internal sensor 114/116 in accordance with some embodiments discussed herein. Each of media units 202A, 202B, 202C and 202D can include, for example, a radio frequency identification (RFID) tag, adhesive label, among other things that may be printed and/or encoded by a linerless printer.

FIGS. 2A-2C also show printhead 206 and platen 208, which may be used to print indicia onto media units 202A, 202B, 202C and 202D. For example, printer 100 may use printhead 206 and platen 208 and/or any other component to print indicia using, e.g., infrared, visible, ultraviolet and/or any other type(s) of ink and/or other materials (e.g., metal, etc.) that may be used for printing. One skilled in the art would appreciate that printer 100 may include one or more additional components, such as rollers, spools, circuitry (such as that discussed in connection with FIG. 4), transceivers, RFID readers, motors, etc., which may be used to process media units 202A, 202B, 202C and 202D and are not shown to avoid unnecessarily overcomplicating the drawings. For example, printer 100 may include an array coupler and other encoding components to encode media units that include RFID circuits, some examples of which are discussed in commonly-assigned U.S. Patent Application No. 2011-0115611, filed Nov. 13, 2009 and titled "Encoding Module, Associated Encoding Element, Connector, Printer-Encoder and Access Control System", which was hereby incorporated by reference in its entirety.

As shown in FIGS. 2A-2C, media units 202A, 202B, 202C and 202D can be directed along a feed path and fed one at a time between the printhead 206 and the platen roller 208 for printing indicia thereon. A ribbon supply roll (not shown to avoid unnecessarily overcomplicating the drawing) can be configured to provide a thermal ribbon (also not shown) that extends along a path such that a portion of the ribbon is positioned between the printhead 206 and the media unit being printed. The printhead 206 can be configured to heat up and be pressed against a portion of the ribbon onto the tag(s) to print indicia. A take-up spool (not shown) can be configured to receive and spool the used ribbon. This printing technique is sometimes referred to as thermal transfer printing. However, several other printing techniques may be used by printer 100 including, but not limited to, direct thermal printing, inkjet printing, dot matrix printing, and/or electro-photographic printing, among others.

As a media unit is printed, another media unit can be fed into the print zone (namely the area between printhead 206 and platen 208 where printing occurs). For example, media units 202A, 202B, 202C and 202D can be loaded into printer 100 on medial roll 210 and printer 100 can be configured to unspool the media units as they are printed as shown in FIGS. 2A and 2B. In other embodiments (not shown), rather than be rolled on media roll 210, media units 202A, 202B, 202C and 202D, among others, can be stacked, fan-folded, and/or otherwise loaded into printer 100 and fed into the print zone by printer 100.

Printer 100 can be configured to use media taken sensor 112 to determine whether a label or other type of media (which may have been printed) is awaiting a user to remove it from landing pad 104. In some embodiments, landing pad 104 may include gap 212 into which light beam 214 may enter when media taken sensor 112 is activated and a media unit is not located on landing pad 104. In some embodiments, such as when media taken sensor 112 includes a transmissive sensor, a receiver 222 may be placed below gap 212. In some embodiments, such as when media taken sensor 112 includes a reflective sensor, a receiver 222 may be placed above gap 212. Although media taken sensor 112 is shown in FIGS. 2A-2C as being positioned on the printed, non-adhesive side of (or "above") the outputted media unit, in some embodiments, media taken sensor 112 (like any other component(s) discussed herein) may be positioned in any other suitable location(s), such as on the opposite side of landing pad 104 (e.g., "below" landing pad 104) and/or on the opposite side of the media unit (e.g., "looking at" the adhesive side of the media unit through gap 212). For example, although internal sensor 114/116 is shown above the media units, one or more (including all) components of internal sensor 114/116 may be located below and/or anywhere else relative to the media units and/or pointed in any direction.

In response to media taken sensor 112 detecting the presence of a media unit, a "media present" data can be generated by media taken sensor 112 (e.g., a digital 1 or a digital 0, a series of 1's and/or 0's, etc.), from which a media present signal may be generated and provided to printer 100's control circuitry (such as, e.g., the processor discussed below). Like other signals discussed herein that are generated based on sensor data, the media present signal may include the media present data in addition to various packet header and/or other formatting changes. In some embodiments, the media generated signal (like other signals discussed herein) is the same as the data generated by the sensor(s) (e.g., the signal does not include any additional 1's and/or 0's as compared to the data generated by the sensor).

In response to receiving the media present signal, the control circuitry can be configured to pause printing until the control circuitry receives a "media clear signal" based on media clear data generated by media taken sensor 112. By only printing when nothing is in light beam 214 the media taken sensor 112, printer jams and other problems can be reduced. Light beam 214 can include light, sound, radio frequency communication signal(s) (such as an RFID interrogation signal) and/or any other means for detecting the presence of, for example, a media unit.

In addition to or instead of the media present signal being used to deactivate components of printer 100 (e.g., pause or otherwise stop printing), reception of the media present signal can be used, in some embodiments, to actuate and/or otherwise enable the operation of cutter 216 and/or other components of printer 100. Cutter 216 can be included in component 106 with media taken sensor 112 and landing pad 104. In some embodiments (not shown) one or more of the components shown as being included in component 106 can be included in main body 108. Also, a tear bar and/or other type of component could be included in addition to or instead of cutter 216.

The data emitted by and received from media sensor 112 can also be used to enable untraditional, novel functionality. For example, media taken sensor 112 can be implemented as a multi-functional, dynamic component that causes printer 100 to respond differently depending on data generated by one or more other components. For example, while printer 100 can be configured to print while media taken sensor 112 is outputting media clear data, printer 100 can also be configured to interpret the media clear data as representing a potential and/or existing problem, error or other type of fault, such as a platen wrap condition. To aid in providing this functionality, the control and/or other circuitry of printer 100 may be configured to receive one or more signals based on data generated by, for example, internal sensor 114/116, a rotational counter sensor associated with the movement of media roll 210, a sensor associated with the movement of another component representative of the movement of the media units, and/or any other component(s) included in printer 100.

By observing or otherwise detecting how the media units (e.g., media units 202A, 202B, 202C and/or 202D) physically move (e.g., movement rate, distance moved, etc.) through the printer, printer 100 can execute an algorithm, such as that discussed in connection with FIG. 3A, that enables printer 100 to determine when—relative to the current and past observed movements of the media unit(s)—media present data is expected to be outputted by media taken sensor 112. For example, when printer 100 determines that media unit 202A is positioned as shown in FIG. 2A, printer 100 can be configured to calculate how many additional motor steps, (partial) revolutions of media roll 210, and/or any other type of "reference units" should occur before media taken sensor 112 is expected to detect the presence of media unit 202A. In some embodiments, such as those where the printer is performing a consistent or measurable number of media units per given period of time, time can be used in the algorithm to determine when media taken sensor 112 should expect to detect the media unit.

Figure 3A:
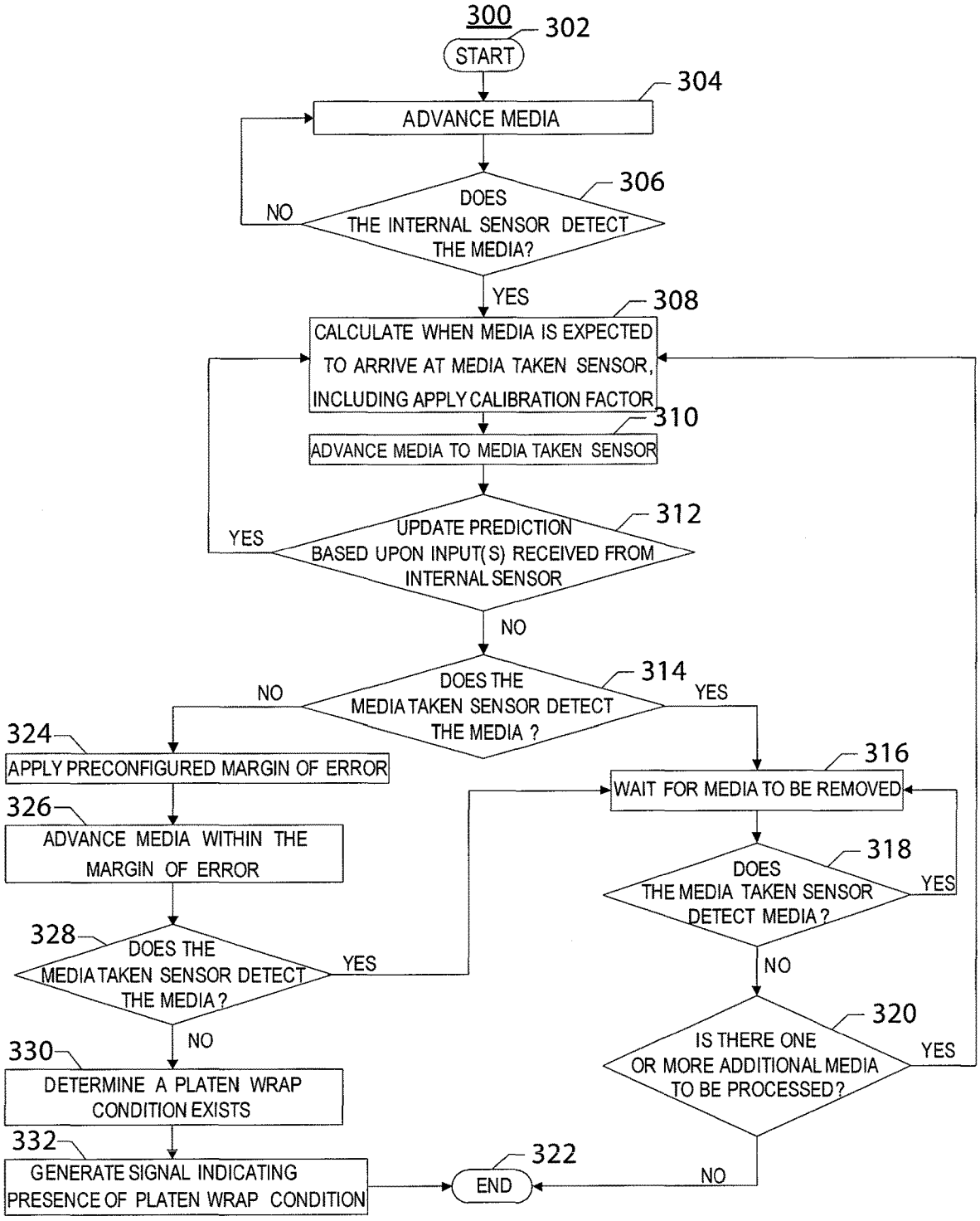
FIGS. 3A and 3B show example process flow diagrams illustrating methods that may be executed by a printer in accordance with some embodiments discussed herein.
Figure 3B:
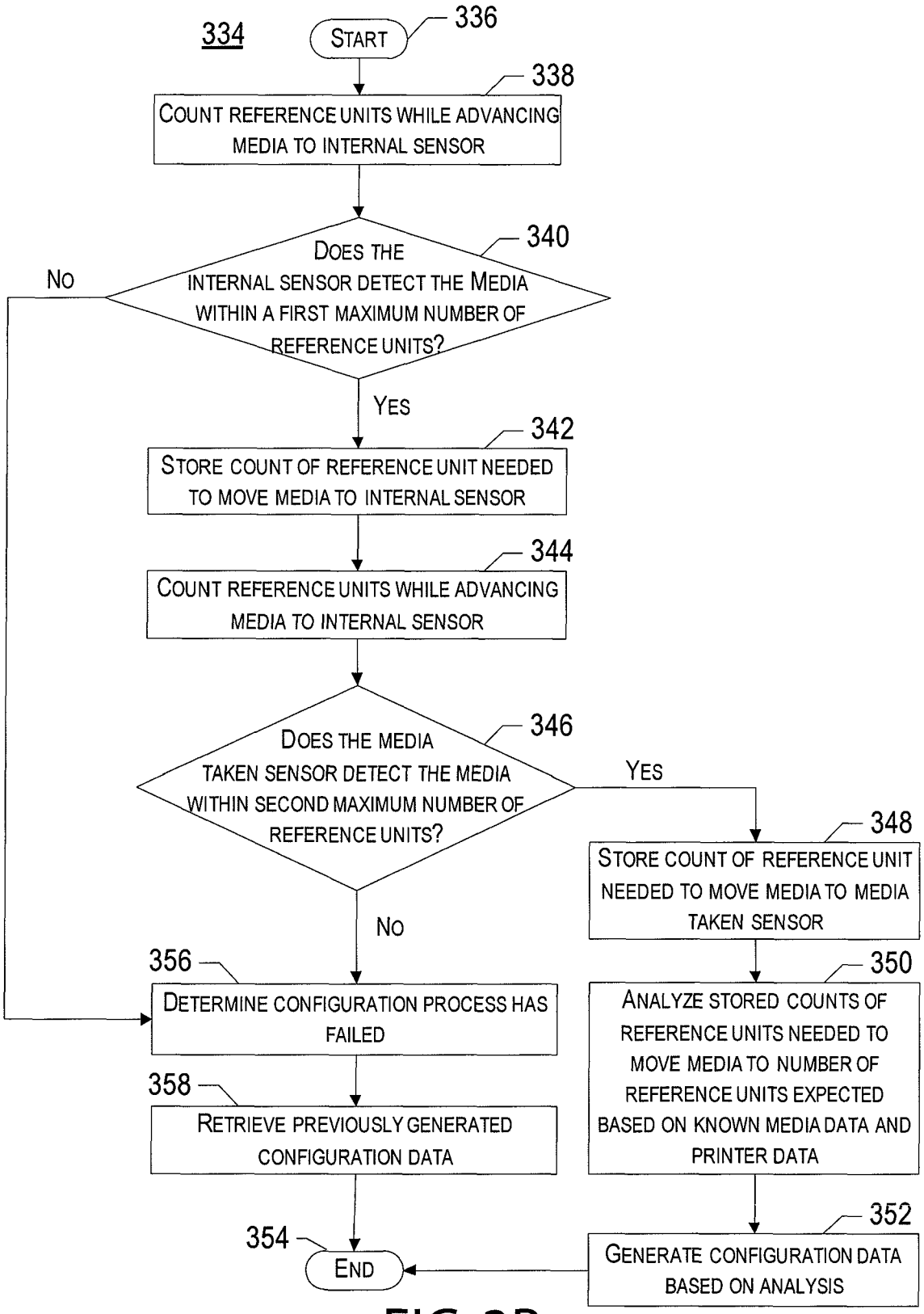

While the algorithms of FIGS. 3A and 3B are shown as processes 300 and 334, respectively, one skilled in the art would appreciate that the algorithm may be represented in any suitable form. Further, processes 300 and 334, like the other processes and algorithms discussed herein, may include more or less variables and decision points than what is explicitly discussed herein.

Process 300 starts at 302. In some embodiments, process 300 may not start unless the media taken sensor (112) is indicating that it is not detecting any media. For example, after printing, printer 100 may be turned OFF, enter standby mode, or otherwise be powered down while a media unit is on the landing pad (104). To help prevent jams, platen wrap and/or other error conditions, before starting process 300, printer 100 can be configured to confirm, e.g., media take sensor 112 is generating media clear data/signal and/or the landing pad is clear before beginning process 300.

At 304, printer 100 can be configured to advance one or more of the media units, such as media unit 202A, from media roll 210 along the feed path through the print zone to landing pad 104. In this regard, the components along the feed path may be considered to be located "upstream" or "downstream" from each other in relation to the direction that media typically moves within printer 100. For example and as shown in FIGS. 2A-2C, media roll 210 is shown as being located upstream from internal sensor 114/116 and, it follows, that internal sensor 114/116 is shown as being located downstream from media roll 210. As another example, internal sensor 114/116 is shown as being upstream from printhead 206 and platen 208, while the media taken sensor 112 is shown as being located downstream from printhead 206 and platen 208.

At 306, a determination is made whether or not one or more internal sensors detect a media unit. For example, a process of printer 100 can be configured to determine whether or not internal sensor 114/116 is detecting media unit 202A as shown in FIG. 2A. In some embodiments, the internal sensor 114/116 may only detect at 306 a particular portion or portions of media unit 202A, sometimes referred to herein as a "movement indicator" (such as a printed mark, notch cutout, etc.). Movement indicators 218A-218H are shown as black marks in FIG. 2A and only some of the reference numerals are included in FIGS. 2B and 2C to avoid unnecessarily overcomplicating the drawings. Movement indicators 218A-218H may be any suitable type(s) of indicators, such as black marks, infrared-responsive marks, ultraviolet-responsive marks, one or more notches or other spaces (that allow a light beam to pass through the media unit), among other things. Internal sensor 114/116 may emit light beam 220 and be configured to read and/or otherwise detect one or more of movement indicators 218A-218H. In response to detecting the presence and/or absence of the movement indicators, internal sensor 114/116 can be configured to generate and output "observed movement data," which printer 100's circuitry can be configured to use to generate "observed movement signals" one or more associated with one or more media units. In this regard, some embodiments of printer 100 can be configured to transform the observed movement (which, as used herein, includes measuring a lack or presence of movement) into a prediction as to when to expect to receive an indication (e.g., media present data/signal) that media taken sensor 112 detects the presence of a media unit. In some embodiments, internal sensor 114/116 may include an optical sensor and/or other type of sensor(s) that can detect any and/or all portions of one or more media units at 306, including portions where movement indicators 218A-218H are absent.

In response to determining at 306 that a media unit (and/or any of its movement indicators) is not being detected by the internal sensor(s), process 300 may return to 304 and continue to advance the media.

In response to determining at 306 that the internal sensor detected media, printer 100 can be configured to determine at 308 when the media is expected to arrive at media taken sensor 112. Among other things, a calibration factor can be applied that is specific to the configuration of the components of printer 100, the type of media loaded in printer 100, the amount of prior use the printer has experienced, and/or any other factor that may impact the determination as to when printer 100 should expect media to progress from the internal sensor(s) to the media taken sensor(s).

In some embodiments, for example, the calibration factor may be determined empirically by executing one or more calibration processes pre-configured into printer 100's circuitry, which may include printer 100 moving and monitoring one or more media units along printer 100's feed path. The calibration factor may be represented by a positive or negative number. For example, when an empirical calibration process is executed with media units measuring 6.00 inches in length, and printer 100 measures the media units as being 5.98 inches in some instances, a negative 0.02 calibration factor may be applied. Some embodiments of printer 100 may be configured to execute a calibration process every time or every so many times media (or a different type of media) is loaded into printer 100. In this regard, some embodiments of printer 100 may be configured to identify the type of media installed in printer 100 and, in response, perform a calibration process. An example algorithm for determining the calibration factor is represented by the process shown and discussed below in connection with FIG. 3B.

In some embodiments, the determined length of the media units and/or the calibration factor may be a relative value as interpreted by the processor of printer 100. For example, the media unit length and/or calibration factor may be expressed in terms of portions and/or discrete amounts of movement(s) of one or more printer components, which are sometimes referred to herein as "reference units." Examples of reference units include, among other things, revolutions or partial revolutions of media roll 210 and motor steps used to drive the media through the feed path, among other things. A negative calibration factor, for example, may represent to printer 100 that the media unit is to arrive a few revolutions or partial revolutions sooner than would otherwise be expected for 6.00 inch media units, while a positive calibration factor may be interpreted by printer 100 that the media unit is to arrive a few revolutions or partial revolutions later than would otherwise be expected for 6.00 inch media units.

In some embodiments, rather than or in addition to empirically determining calibration factors (using, e.g., a process such as that shown in FIG. 3B), one or more variables (e.g., media roll circumference, distance associated with each motor step, etc.) used by the algorithm to establish the calibration factor may be downloaded from a remote source (e.g., from over a network, removable flash memory hard drive, a RFID chip associated with the media unit(s) and/or roll of media units, and/or from any other accessible data source), retrieved from memory included in printer 100, and/or obtained from any other suitable source of data.

After and/or concurrent with executing the calculation at 308, process 300 can proceed to 310 where printer 100 can be configured to advance the media to media taken sensor 112. As the printer moves the media downstream along the feed path, printer 100 may monitor the media and/or its movement indicator(s) (e.g., count notches and/or marks on the media, log the number of reference units between each pair of movement indicators, etc.), and generate the observed movement data. As observed movement data is generated, other components of printer 100, such as a processor, may be configured to generate reference movement signals based on reference unit data provided by a printer component, such as a rotational counter, motor step counter, and/or any other component printer 100 may be configured to use as a reference unit generator. Printer 100 may then be configured to correlate how many reference units should be completed (e.g., how far media roll 210 should rotate or how many motor steps are should be executed) and/or how many movement indicators 218A-218H should be detected by internal sensor 114/116 as media unit 202A moves downstream from the position shown in FIG. 2A to the position shown in FIG. 2B, where media unit 202A is within the field of view of media taken sensor 112.

In addition to determining an expected number of reference units and/or movement indicators associated with media unit 202A's expected movement, printer 100 may also be configured to generate observed movement data and/or reference unit data that are associated with media unit 202B and/or any other media unit(s) being processed by printer 100. To enable this functionality, some embodiments can be configured to determine where one media unit ends and the next/adjacent upstream media unit begins (e.g., the junction of media units 202A and 202B in FIG. 2A). For example, printer 100 can be configured to know that every second movement indicator (such as movement indicators 218C, 218E and 218G) is located at or near the junction of two adjacent media units (such as at the beginning of media units 202B, 202C and 202D).

The printer can be configured to confirm at 312 in process 300 whether the media unit is moving as expected. To make this determination, printer 100 may compare the number of reference units that have been performed (e.g., motor steps, partial revolutions of media roll 210, and/or other internal printer components' operational units) to the number of movement indicators (e.g., marks and/or notches) that have been detected by internal sensor 114/116, and confirm that the numbers are consistent with what was determined during the calibration process. For example, when printer 100 expects (based on its current configuration and calibration settings) there to be 100 motor steps required to move media unit 202A from the position shown in FIG. 2A to the position shown in FIG. 2B, and printer 100 is configured to know there is a movement indicator at the beginning and middle of media unit 202B (e.g., movement indicators 218C and 218D of media unit 202B), printer 100 can determine when internal sensor 114/116 detects the middle movement indicator (218D) and use this information to determine if 50 motor steps have been performed since detecting the beginning movement indicator (218C). As such, internal sensor 114/116 can be configured to determine when each of media units 202A, 202B, etc. arrives, moves within and/or exits its field of view by detecting movement indicators 218A-218H. As another example, in response to internal sensor 114 detecting movement indicator 218C (after detecting movement indicators 218A and 218B), printer 100 may be configured to determine that media unit 202A is exiting its field of view and/or media unit 202B is entering field of view of light beam 220. In some embodiments, internal sensor 114 can continuously and/or periodically monitor the movement of one or more upstream media units, such as media unit 202B, while media unit 202A is traveling through the print zone and update the predicted arrival of media unit 202A at media taken sensor 112 based on the monitoring of upstream media units.

In response to determining at 312 the observed movement data is different than "expected movement data" (i.e., data relating a ratio of expected number reference units to movement indicators resulting from the calculation(s) executed at 308), process 300 can return to 308 and refine the expected movement data. In some embodiments, refining the expected movement data may include updating the calibration factor, thereby enabling the calibration factor to be a dynamic value that is empirically determined during an actual printing process. A dynamic calibration factor may be implemented in embodiments that utilize an initially downloaded calibration factor (as opposed to a calibration factor initially determined through empirical testing).

In response to determining at 312 that the observed movement data is the same as or within a predefined margin of error of the expected movement data, process 300 may proceed to 314 and determine whether or not the media unit has arrived at the media taken sensor when expected based on the calculation(s) made at 308.

At 314, a determination is made after printer 100 has performed the predicted number of reference units expected to move the media unit to media taken sensor 112. For example, if 100 reference units are expected to media unit 202A from the position shown in FIG. 2A to the position shown in FIG. 2B, printer 100 can be configured to perform 100 motor steps at 314 after media unit 202A is detected at 306.

The number of reference units for each media unit may be the same and/or be different. For example, media unit 202B may be associated with more or less reference units than media unit 202A, because, e.g., media unit 202B may be a different length than media unit 202A, the calibration factor may be updated dynamically during the printing process of media unit 202A and/or media unit 202B, among other reasons.

In response to determining at 314 that the media taken sensor detects the media unit when expected, process 300 proceeds to 316 and waits for the media unit to be removed from the landing pad (e.g., landing pad 104). While waiting for the media unit to be removed, printing may be paused. In some embodiments, cutter 216 can be actuated in response to media taken sensor 112 detecting the media unit arriving on landing pad 104.

At 318, a determination is made as to whether the media taken sensor still detects the media unit. If so, process 300 repeats 316 and waits for the media to be removed by the user (or otherwise) from the landing pad.

When the media unit is determined to be removed from the landing pad, printer 100 can determine whether there is at least one more additional media unit to be processed. If so, process 300 returns to 308. In other embodiments, process 300 may return to a different step, such as 304. In response to determining there are no more media units to be processed, process 300 ends at 322.

Returning to 314, in response to determining that the media taken sensor has failed to detect the media unit when expected, process 300 proceeds to 324. The media unit wrapping around the platen is one example of a reason why process 300 may proceed to 324. As shown in FIG. 2C, for example, when media unit 202A wraps around platen 208, the other media units may continue to move downstream along printer 100's feed path. But because media unit 202A is wrapped around platen 208, media taken sensor 112 may continue detecting the absence of media unit 202A, even though media unit 202A should have arrived onto landing pad 104. In this regard, while media taken sensor 112 can be used by printer 100 to pause printing when a media unit is detected, media taken sensor 112 can have a dual use and cause printing to be paused when a media unit is not detected when it was expected (based on, e.g., past observations and/or measurements made by printer 100's internal sensors and/or other components). In other words, printer 100 can be configured to pause printing in some instances when the downstream, media taken sensor 112 fails to detect a media unit.

Some embodiments may include a preconfigured margin of error that may be applied at 324. For example, the preconfigured margin of error can be a positive number, percentage of the length of a media unit (e.g., 10% of media unit length), and/or any other suitable parameter that represents additional reference units that should be moved downstream before determining that there is an error (and after failing to detect the media unit when expected at 314). For example, when each media unit is associated with 100 motor steps, the margin of error can be 1 motor step to 200 motor steps. With a larger the margin of error (e.g., equal to or larger than the length of a media unit), there will be less of a chance of there being a false alarm, but a greater chance to have a more severe platen wrap. For example, when the margin of error is configured to be one tenth the length of the media unit, only one tenth (or less) of the media unit is likely to get wrapped around the platen before an error alert is generated. Whereas when the margin of error is equal to the length of the media unit, while there is a low likelihood of a false alarm, an entire media unit (or almost an entire media unit) is likely to be wrapped around the platen when a platen wrap situation does occur. In some embodiments, the margin of error can be configured by a user of printer 100, preconfigured at the factory, and/or any configured at any other time.

At 326, the media is advanced within the distance allotted for the margin of error. In some embodiments, the internal sensor(s) can be configured to confirm that the media is actually moving while advancing within the margin of error. In response to determining that the media is not advancing properly internally while executing 326 (and/or any other step discussed herein), an alarm may be generated that indicates an internal problem (e.g., internal jam, out of media, sensor malfunction, etc.).

After and/or while advancing the media unit within the preconfigured margin of error, a determination can be made at 328 whether or not the media taken sensor detects the media. If so, process 300 may proceed to 318. If not, process 300 may proceed to 330 and determine that a platen wrap condition and/or other fault exists or likely exists. At 332, printer 100 may generate an error signal indicating the presence of a platen wrap condition. For example, light emitting device 110 may be illuminated a particular color, a text message may be displayed on a graphical user interface (included in the printer and/or at a remote location), an audible alarm may sound, and/or any other suitable error alert may be provided that is indicative of the platen wrap condition. Additionally, printer 100 can be configured to cease printing until it determines the platen wrap condition is corrected and/or reset. Process 300 then ends at 322.

FIG. 3B shows an example algorithm, represented by process 334, for determining the calibration factor that may be used, for example, at 308 of process 300 shown in FIG. 3A. Process 334 starts at 336.

At 338, process 334 advances the media one or more predetermined reference units and counts each reference unit as the media advances downstream to the internal sensor. In some embodiments, the printer may be preconfigured to associate a predetermined number of reference units needed to move media from media roll 210 to internal sensor 114/116. For example, the distance between media roll 210 and internal sensor 114/116 may be known, and each reference unit may be associated with a distance that it causes media to move. The printer may also be configured to know approximately how many reference units it takes to move media from, for example, internal sensor 114/116 to media taken sensor 112, and/or from media roll 210 to media taken sensor 112. For example, each reference unit may be a motor step that printer 100 associates with moving a media label 0.01 inches (on average), and printer 100 may be configured to know the feed path measures less than a half an inch between media roll 210 and internal sensor 114/116, therefore printer 100 may be configured to determine that internal sensor 114/116 should be able to see a media label within 50 motor steps. Any of these variables (e.g., the distances between components and/or distance associated with reference units, references associated with distances between components, etc.) can be changed and/or otherwise configurable by a user and/or other system in accordance with some embodiments.

At 340, a determination can be made by the printer as to whether or not its internal sensor has generated an indication (e.g., observation data/signal) while the media is being advanced downstream. In some embodiments, printer 100 may be configured to only perform a predetermined maximum number of reference units. The maximum number of reference units may be preconfigured to be, for example, 80 motor steps when a media label is expected to be detected by internal sensor 114/116 after 50 motor steps.

In response to determining at 340 that internal sensor 114/116 has detected the media unit within the maximum number of reference units, the printer can be configured to store the count of the number of reference units needed to move the media to the internal sensor. The stored data can be subsequently used to generate configuration data and/or to assist the printer in conducting future iterations of process 334 (e.g., assist in determining the maximum number of reference units used at 340), among other things.

At 344, the printer continues to move the media down the feed path, while counting the reference units performed during the advancement of the media. A second maximum number of reference units may be preconfigured into the printer, where the second maximum of reference units is associated with the number of reference units to be performed to move the media from the internal sensor to the media taken sensor.

In response to determining at 346 that the media taken sensor has generated an indication that the media has been detected (e.g., a media present data/signal) in less reference units than the maximum number of reference units, the printer can be configured to determine at 348 the number of reference units needed to move the media to the media taken sensor.

At 350, the printer can be configured to analyze the stored counts of reference units needed to move the media to the internal taken sensor and/or the media taken sensor. For example, the printer can be configured to compare this newly generated empirical data to the number of reference units that may have been expected to move the media to one or more of the sensors (and/or any other suitable location). For example, if the printer expected that 50 motor steps would be needed to move the media from media spool 210 to internal sensor 114/116, and it actually took 60 motor steps, the printer can be configured to generate new configuration data at 352. In some embodiments, such as when there is no pre-existing configuration data, the printer can be configured to use the empirical data as the new configuration data. In this regard, the printer can be configured to determine the number of reference units to be expected between the media roll and the various sensors as well as between various sensors included in the printer. Process 334 then ends at 354.

The calibration data generated in process 344 can be specific to the media being moved throughout process 334. As such, process 344 may be executed after the printer determines that a new type of media is installed. For example, printer 100 may store calibration data for 6 inch media labels and different calibration data for 4 inch media labels, and yet different calibration data for 4 RFID tag cards. In other embodiments the same calibration data can be used for at least two of the same types of media. Printer 100 may also be configured to determine the type of media unit and/or whether a calibration process should be performed based on properties (e.g., transparency, density, etc.) of a media unit detected by one or more of the sensors include din printer 100.

Process 334 (and/or any other calibration processes) may also be performed after/while each media unit (e.g., label, tag, etc.) is printed. But in some embodiments, the calibration process may be disabled temporarily or otherwise in some instances. For example, in response to determining (based on the output of media taken sensor 112) that the media unit was removed from landing pad 104 before cutter 216 finishes cutting the printed media unit (202A), printer 100 can be configured to skip the calibration process for one or more of the next media units being printed. In this regard, if a user removes the media unit very quickly as the media unit is outputted onto the landing pad, the printer will not miscalculate the number of reference units associated with moving the media unit to the media taken sensor 112, but will still detect the presence of the media unit and not generate a platen wrap error condition.

Returning to process 334, in response to determining at 340 and/or 346 that the maximum number of reference units has been reached without the corresponding sensor detecting the media, the printer can be configured to determine at 356 that the configuration process has failed. At 358, the printer can retrieve previously generated configuration data and use the previously generated configuration data for future printing.

Figure 4:
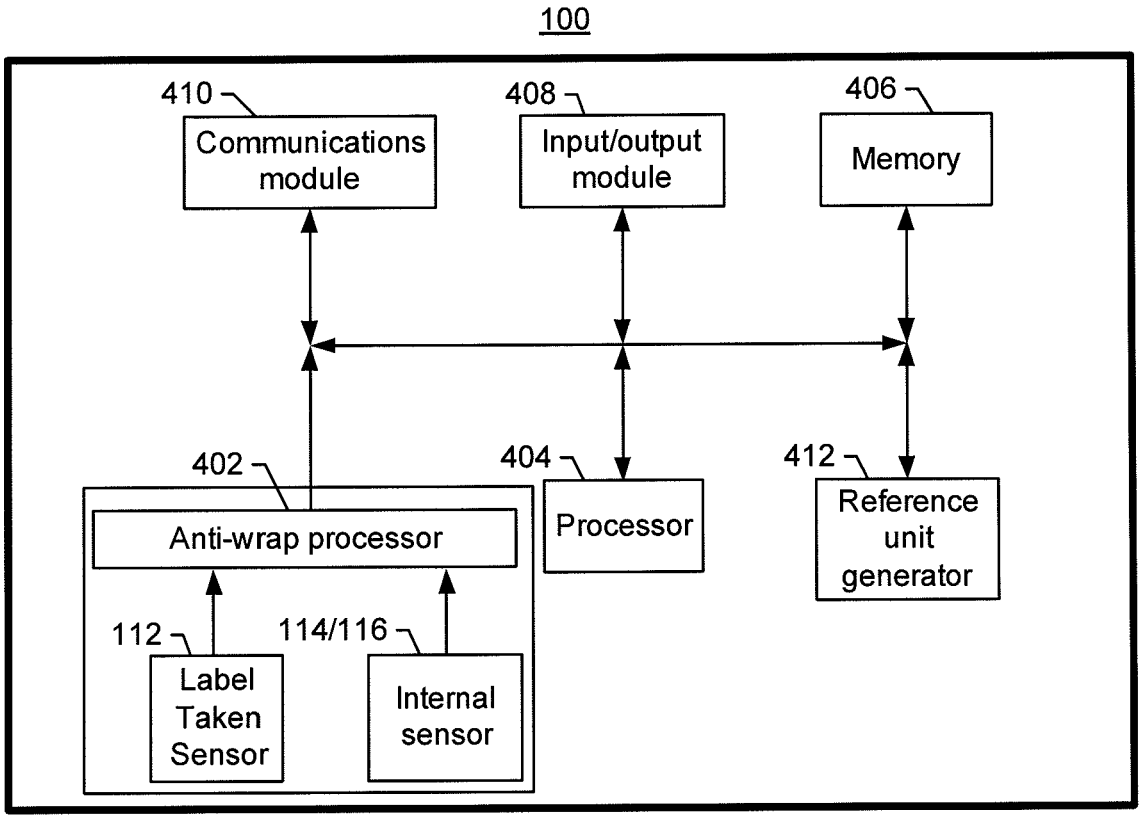
FIG. 4 shows a block diagram of example circuitry that may be included in a printer in accordance with some embodiments discussed herein.

FIG. 4 shows example circuitry that may be included in some embodiments of printer 100. One or more of the components shown in FIG. 4, like other components and functions discussed herein, can be included in one or more other devices despite being shown or discussed in connection with printer 100. Similarly, additional circuitry, components and/or functionality may be included in printer 100, and/or one or more circuitry components shown in FIG. 4 may be omitted from some embodiments without departing from the spirit of the present invention.

Some embodiments may include a dedicated anti-wrap processor, such as anti-wrap processor 402, that is configured to receive the raw data (e.g., 1's and 0's) from, for example, media taken sensor 112 and/or internal sensor 114/116. Anti-wrap processor 402 can also be configured to generate and provide the media present signal and/or the media clear signal, and/or any other signal representative of what is being detected and data generated by media taken sensor 112 and/or internal sensor 114/116. In some embodiments, anti-wrap processor 402 may also receive data and/or one or more signals from one or more circuitry components, such as reference unit generator 412, which may include a rotational counter, motor step counter, and/or any other component configured to generate reference movement data. Processor 402 can then generate reference movement signals based on the reference movement data. In some embodiments, reference unit generator 412 and/or any other component can be configured to generate the reference movement signals.

In some embodiments, anti-wrap processor 402 can provide the signal(s) it generates to processor 404. Processor 404 can control other aspects of printer 100. For example, processor 404 can control the printing and data communications functionality. In some embodiments, anti-wrap processor 402, like other components discussed herein, can be omitted from printer 100, and processor 404 can be configured to provide the functionality discussed in connection with anti-wrap processor 402.

Anti-wrap processor 402 and/or processor 404 can, for example, each or collectively be embodied as various means including one or more microprocessors with accompanying digital signal processor(s), processor(s) without an accompanying digital signal processor, one or more coprocessors, multi-core processors, controllers, computers, various other processing elements including integrated circuits such as, for example, an ASIC (application specific integrated circuit) or FPGA (field programmable gate array), or some combination thereof. Accordingly, although each is shown in FIG. 4 as a separate, single processor, in some embodiments anti-wrap processor 402 and/or processor 404 comprises a plurality of processors and/or any other type of control circuitry. The plurality of processors, for example, may be embodied on a single computing device or may be distributed across a plurality of computing devices collectively configured to function as anti-wrap processor 402 and/or processor 404. The plurality of processors may be in operative communication with each other and may be collectively configured to perform one or more functionalities of anti-wrap processor 402 and/or processor 404 as described herein. In an example embodiment, anti-wrap processor 402 and/or processor 404 is configured to execute instructions stored in memory 406 (discussed below) and/or that are otherwise accessible to anti-wrap processor 402 and/or processor 404. These instructions, when executed by anti-wrap processor 402 and/or processor 404, may cause printer 100 to perform one or more of the functionalities described herein. As such, whether configured by hardware, firmware/software methods, or by a combination thereof, anti-wrap processor 402 and/or processor 404 may comprise an entity capable of performing operations according to embodiments of the present invention while configured accordingly. Thus, for example, when anti-wrap processor 402 and/or processor 404 is embodied as an ASIC, FPGA or the like, anti-wrap processor 402 and/or processor 404 may comprise specifically configured hardware for conducting one or more operations described herein. Alternatively, as another example, when anti-wrap processor 402 and/or processor 404 is embodied as an executor of instructions, such as those that may be stored in memory 406, the instructions may specifically configure anti-wrap processor 402 and/or processor 404 to perform one or more algorithms and operations described herein.

Processor 404 may be configured to receive a signal from input/output module 408, which may include specialized circuitry, one or more ports (parallel ports, serial ports, such as universal serial bus ("USB") ports, and/or any other ports), and/or any other component that facilitates the reception of signals from one or more input components. In some embodiments, input/output module 408 can function as a user input interface and, in turn, receive data from any number and/or types of devices and/or users (e.g., local user, network user, etc.). For example, input/output module 408 may be electrically coupled to a touch-screen display component and/or other type of a user input device (e.g., keypads, mouse, etc.). Input/output module 408 can also be configured to function as an output module that provides data to, e.g., a speaker and/or other output device, such as light emitting device 110. Although more than one input/output module can be included in printer 100, only one is shown in FIG. 4 (like the other components discussed herein) to avoid overcomplicating the drawing. Similarly, input/output module 408 can be divided into separate input module(s) and output module(s).

Processor 404 can also be configured to utilize communications module 410 to communicate with one or more remote machines (e.g., via a network). Communications module 410 can include hardware, software, and/or any other means for transmitting and/or receiving content or any other type of data from a network or other type of device.

In some embodiments, anti-wrap processor 402 and/or processor 404 is in communication with and/or includes a non-transitory storage device, such as memory 406, which may be volatile and/or non-volatile memory that stores content and/or any other data. For example, memory 406 can store data generated by, transmitted from, and/or received by printer 100. Also for example, memory 406 can be configured to store software applications, instructions or the like for anti-wrap processor 402 and/or processor 404 to perform steps associated with operation of printer 100. For example, memory 406 may be a non-transitory storage medium that stores computer program code comprising instructions or other executable portions that anti-wrap processor 402 and/or processor 404 executes to perform the functions described herein, including that discussed in connection with, e.g., FIGS. 3A and 3B.

In this regard, printer 100 may include any type of circuitry to facilitate the functionality discussed herein. Additionally, embodiments discussed herein are not limited to printers and may be used to in apparatuses and systems that do not include printing functionality. For example, circuitry commonly found in various computing devices and other types of machines (e.g., desktop computer, laptop computer, tablet, etc.) may be configured to perform at least some of the functionality discussed herein.

For example, anti-wrap processor 402 and/or processor 404 can be configured to implement at least most of the functionality discussed herein, including that discussed in connection with the processes of FIGS. 3A and 3B. Further, any suitable methods, computer program products, systems and/or other types of machines can be configured to implement process 300, process 334 and/or the other functionality discussed herein. It will be understood that each operation, action, step and/or other types of functions shown in the diagrams, and/or combinations of functions in the diagrams, can be implemented by various means. Means for implementing the functions of the flow diagram, combinations of the actions in the diagram, and/or other functionality of example embodiments of the present invention described herein, may include hardware and/or a computer program product including a non-transitory computer-readable storage medium (as opposed to or in addition to a computer-readable transmission medium) having one or more computer program code instructions, program instructions, or executable computer-readable program code instructions stored therein. For example, program code instructions that may be associated with the implementation of FIGS. 3A and/or 3B may be stored on one or more storage devices, such as memory 406, and executed by one or more processors, such anti-wrap processor 402 and/or processor 404. Additionally or alternatively, one or more of the program code instructions discussed herein may be stored and/or performed by distributed components, such as those that may be connected to printer 100 via a network or other communications interface (such as communications module 410). As will be appreciated, any such program code instructions may be loaded onto computers, processors, other programmable apparatuses or network thereof from one or more computer-readable storage mediums to produce a particular machine, such that the particular machine becomes a means for implementing the functions of the actions discussed in connection with, e.g., FIGS. 3A and 3B and/or the other drawings discussed herein.

The program code instructions stored on the programmable apparatus may also be stored in a non-transitory computer-readable storage medium that can direct a computer, a processor (such as anti-wrap processor 402 and/or processor 404) and/or other programmable apparatus to function in a particular manner to thereby generate a particular article of manufacture. The article of manufacture becomes a means for implementing the functions of the actions discussed in connection with, e.g., FIGS. 3A and 3B. The program code instructions may be retrieved from a computer-readable storage medium and loaded into a computer, processor, or other programmable apparatus to configure the computer, processor, or other programmable apparatus to execute actions to be performed on or by the computer, processor, or other programmable apparatus. Retrieval, loading, and execution of the program code instructions may be performed sequentially such that one instruction is retrieved, loaded, and executed at a time. In some example embodiments, retrieval, loading and/or execution may be performed in parallel by one or more machines, such that multiple instructions are retrieved, loaded, and/or executed together. Execution of the program code instructions may produce a computer-implemented process such that the instructions executed by the computer, processor, other programmable apparatus, or network thereof provide actions for implementing the functions specified in the actions discussed in connection with, e.g., processes 300 and/or 334.

FIGS. 5A-5E show various views of an example component 106 that may be used in accordance with some embodiments discussed herein. Component 106 may be configured to be a removable component (e.g., configured to be detached without damaging component 106 and/or main body 108 of printer 100) or a non-detachable (e.g., can be removed only upon damaging and/or without being able to be re-attached to printer 100 without repair being needed).

Figure 5A:
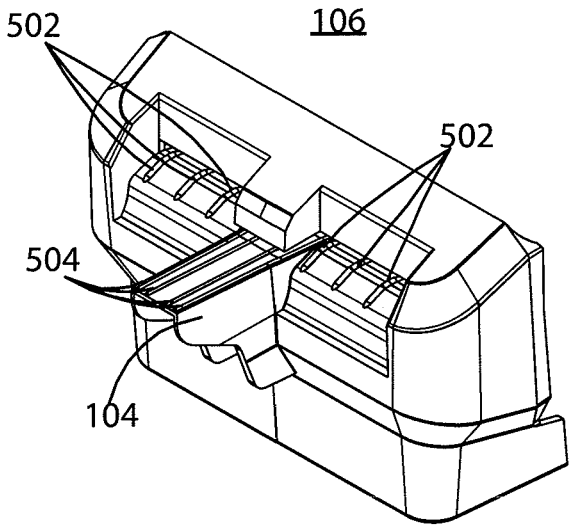
FIGS. 5A-5F show various views of an example component that may be included in a printer accordance with some embodiments discussed herein.
Figure 5B:
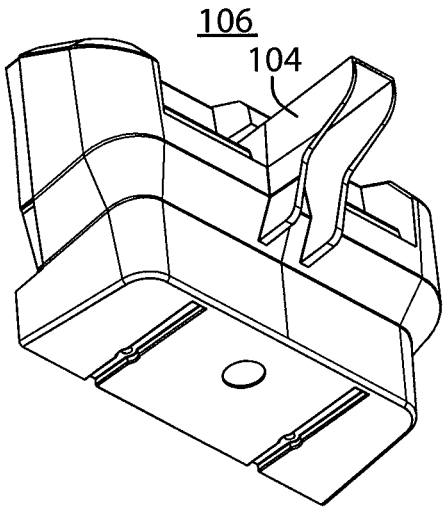

FIG. 5A shows a top-front perspective view of component 106 and FIG. 5B shows a bottom-front perspective view of component 106. Component 106 can comprise any suitable materials, including plastic, rubber, metal, glass, carbon fiber, among other things. Component 106 may also include features, such as ribs 502 and/or landing pad ribs 504. Ribs 502 and/or landing pad ribs 504 may be configured to allow some embodiments to print an adhesive backed label and allow the label to adhere to the ribs while still being easily removed by a user. For example, the dimensions (e.g., height, width, and length), spacing between, number, and material(s) of ribs 502 and/or landing pad ribs 504 may be chosen to facilitate one or more intended uses of printer 100 (e.g., printing of adhesive-backed media, specific type(s) of adhesive on the media, etc.).

FIGS. 5C-5F show an example with dimensions to give relative ratios of the components that may be included in accordance with some embodiments of component 106. In the example shown in FIGS. 5C-5F, a relatively narrow landing pad 104 and narrow snoot, snoot 506, is included to aid in allowing a user's fingers to remove relatively small and/or other type of media that would be more obstructed by a larger landing pad and/or snoot.

Figure 5C:
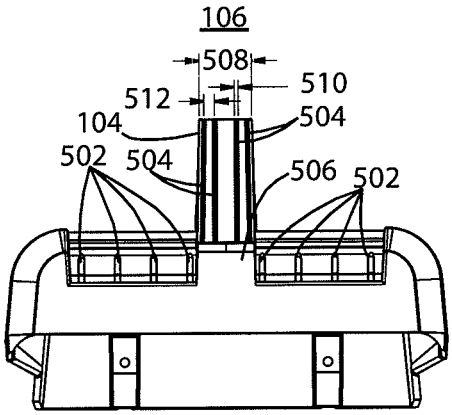

FIG. 5C shows a top view of component 106. Landing pad 106 can have a width 508, which may be 0.72 inches (plus or minus 0.01 inches). Landing pad ribs 504 can have a width 510, which may be 0.05 inches (plus or minus 0.01 inches), and be separated by dimension 512, which may be 0.15 inches (plus or minus 0.01 inches).

Figure 5D:
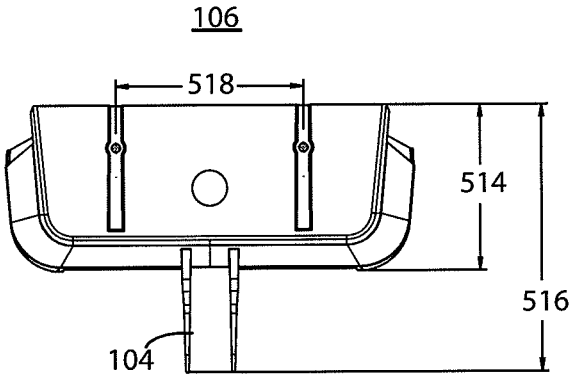

FIG. 5D shows a bottom view of component 106. The dimension represented by 514 may be 2.458 inches (plus or minus 0.030 inches), while the dimension represented by 516 may be 3.953 (plus or minus 0.030 inches). As such, landing pad 104 may extend more than 50% farther than dimension 514 of component 106. On the bottom of component 106, two through-holes, which may be configured to receive screws to removably, physically couple component 106 to main body 108 of printer 100, may be separated by dimension 518, which may be 2.800 inches (plus or minus 0.030 inches).

Figure 5E:
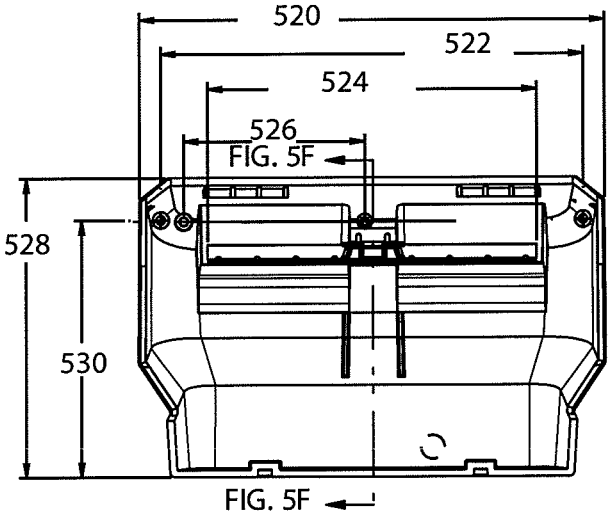

FIG. 5E shows a front view of component 106. Dimension 520 may be 6.074 inches (plus or minus 0.015 inches). Dimension 522 may be 5.512 inches (plus or minus 0.015 inches). Dimension 524 is associated with the opening from which media may be outputted by printer 100. Dimension 524 may be 4.284 inches (plus or minus 0.015 inches). As such, the width of landing pad 104, namely dimension 508, can be less than 20% the width of the opening from which media is outputted by component 106. Dimension 526 may be 2.35 inches (plus or minus 0.01 inches). Dimension 528 may be 3.895 inches (plus or minus 0.015 inches). Dimension 530 may be 3.357 inches (plus or minus 0.01 inches).

Figure 5F:
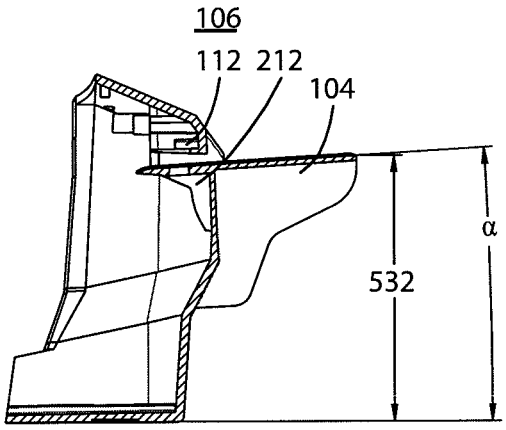

FIG. 5E also shows the relative perspective of component 106 provided by FIG. 5F, which is a side-cutaway view of component 106. Landing pad 104 may have a slight upward slope in some embodiments. For example, dimension 532 can be 2.983 inches (plus or minus 0.020 inches), and angle a can be 3.5 degrees (plus or minus a 1.0 degrees). Also shown in FIG. 5E is an exemplary location of media taken sensor 112 and gap 212, as discussed above.

Many modifications and other embodiments of the inventions set forth herein will come to mind to one skilled in the art to which these inventions pertain having the benefit of the teachings presented in the foregoing descriptions and the associated drawings. For example, the anti-platen wrap features, although shown in conjunction with the unique configuration of component 106, can be implemented in any suitable device regardless of the shape, size and/or functionality of the device's other components. Further, although the discussion has been presented in connection with a linerless media printer, the anti-platen wrap features and/or narrow landing pad/snoot features can be implemented in devices other than linerless media printers. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An assembly comprising:

a landing pad configured to receive media after the media is cut, the landing pad defining a first end adjacent a cutter, a second end opposite the first end, and a gap positioned between the first end and the second end, wherein the landing pad comprises ribs extending between the first end and the second end of the landing pad; and an emitter, wherein the gap is configured to allow light from the emitter to pass through the gap when the media is not located on the landing pad.

2. The assembly of claim 1, wherein the emitter is positioned to direct light toward a printed side of the media.

3. The assembly of claim 1, wherein the cutter activates when the media is located on the landing pad.

4. The assembly of claim 3, further comprising a receiver configured to receive the light.

5. The assembly of claim 4, wherein the receiver is a transmissive sensor.

6. The assembly of claim 4, wherein the receiver is a reflective sensor.

7. The assembly of claim 1, further comprising a receiver located opposite the gap from the emitter.

8. The assembly of claim 1, further comprising a media feed path along which the media travels, wherein the emitter is mounted opposite the media feed path from the gap.

9. The assembly of claim 1, wherein the media is a linerless label.

10. The assembly of claim 1, wherein the cutter is adapted to receive media from a media processing device.

11. The assembly of claim 10, wherein the landing pad is adapted to receive a cut media.

12. The assembly of claim 1, wherein the landing pad is tapered between the first end and the second end.

13. The assembly of claim 1, wherein the emitter is opposite the landing pad from a receiver.

14. The assembly of claim 1, wherein the emitter is mounted on a same side of the landing pad as a receiver.

15. The assembly of claim 1, wherein the gap is configured such that the light does not pass through the gap when the media is located on the landing pad.

16. The assembly of claim 1, wherein the landing pad is angled relative a media feed path.

17. A media processing device comprising:

a printer;

a cutter;

a landing pad configured to receive media after the media is cut, the landing pad defining a first end adjacent a cutter, a second end opposite the first end, and a gap positioned between the first end and the second end, wherein the landing pad comprises ribs extending between the first end and the second end of the landing pad; and an emitter, wherein the gap is configured to allow light from the emitter to pass through the gap when the media is not located on the landing pad.

18. An assembly comprising:

a landing pad configured to receive media after the media is cut, the landing pad defining a first end adjacent a cutter, a second end opposite the first end, and a gap positioned between the first end and the second end, wherein the landing pad is tapered between the first end and the second end; and an emitter, wherein the gap is configured to allow light from the emitter to pass through the gap when the media is not located on the landing pad.

* * * * *